US007518557B2

(12) United States Patent
Lin et al.

(10) Patent No.: US 7,518,557 B2
(45) Date of Patent: Apr. 14, 2009

(54) ANTENNA

(75) Inventors: Yi-Cheng Lin, Taipei (TW); Chih-Hao Lin, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 11/948,944

(22) Filed: Nov. 30, 2007

(65) Prior Publication Data

US 2008/0258979 A1 Oct. 23, 2008

(30) Foreign Application Priority Data

Apr. 23, 2007 (TW) ..... 96114244 A

(51) Int. Cl.
*H01Q 1/38* (2006.01)
*H01Q 5/00* (2006.01)
*H01Q 9/04* (2006.01)

(52) U.S. Cl. ..... 343/700 MS; 343/846; 343/895

(58) Field of Classification Search ..... 343/700 MS, 343/846, 895
See application file for complete search history.

(56) References Cited

U.S. PATENT DOCUMENTS 6,937,196 B2 * 8/2005 Korva ..... 343/702
2007/0182658 A1 * 8/2007 Ozden ..... 343/866

* cited by examiner

*Primary Examiner*—Anh Q Tran
(74) *Attorney, Agent, or Firm*—Quintero Law Office

(57) ABSTRACT

An antenna is provided comprising a transmission element, a ground element, a first parasitic element, a second parasitic element and a third parasitic element. The transmission element is located on a first plane, wherein the transmission element is T shaped, and comprises a first transmission portion and a second transmission portion and the second transmission portion is perpendicular to the first transmission portion and connected to an end thereof. The ground element is located on a second plane parallel to the first plane. The first parasitic element, the second parasitic element and the third parasitic element are connected to the ground element and located on the second plane.

17 Claims, 7 Drawing Sheets

ANTENNA

BACKGROUND OF THE INVENTION

1. Field of the Invention

The invention relates to an antenna, and more particularly to an antenna for multifunction and multi-standard terminals.

2. Description of the Related Art

Conventionally, planar inverted F antenna (PIFA) or slot antenna utilizes transmission elements with particular shape and length for transmitting GSM signal (890-960 MHz), DCS signal (1710-1880 MHz), PCS signal (1850-1990 MHz), UMTS signal (1920-2170 MHz), WLAN IEEE 802.11 b/g signal (2400-2500 MHz) or WiMAX signal (3400-3600 MHz). However, when conventional antenna is utilized in multi-standard terminal applications, transmission elements for transmitting different signals of different standards are separated from each other to reduce noise, and size of antenna is thus increased.

BRIEF SUMMARY OF THE INVENTION

A detailed description is given in the following embodiments with reference to the accompanying drawings.

An antenna comprises a transmission element, a ground element, a first parasitic element, a second parasitic element, and a third parasitic element. The transmission element is located on a first plane, wherein the transmission element is T shaped, and comprises a first transmission portion and a second transmission portion and the second transmission portion is perpendicular to the first transmission portion and connected to an end thereof. The ground element is located on a second plane parallel to the first plane. The first parasitic element, the second parasitic element and the third parasitic element are connected to the ground element and located on the second plane.

The invention transmits GSM signal (890-960 MHz), DCS signal (1710-1880 MHz), PCS signal (1850-1990 MHz), UMTS signal (1920-2170 MHz), WLAN IEEE 802.11 b/g signal (2400-2500 MHz) and WiMAX signal (3400-3600 MHz) with a smaller sized antenna.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
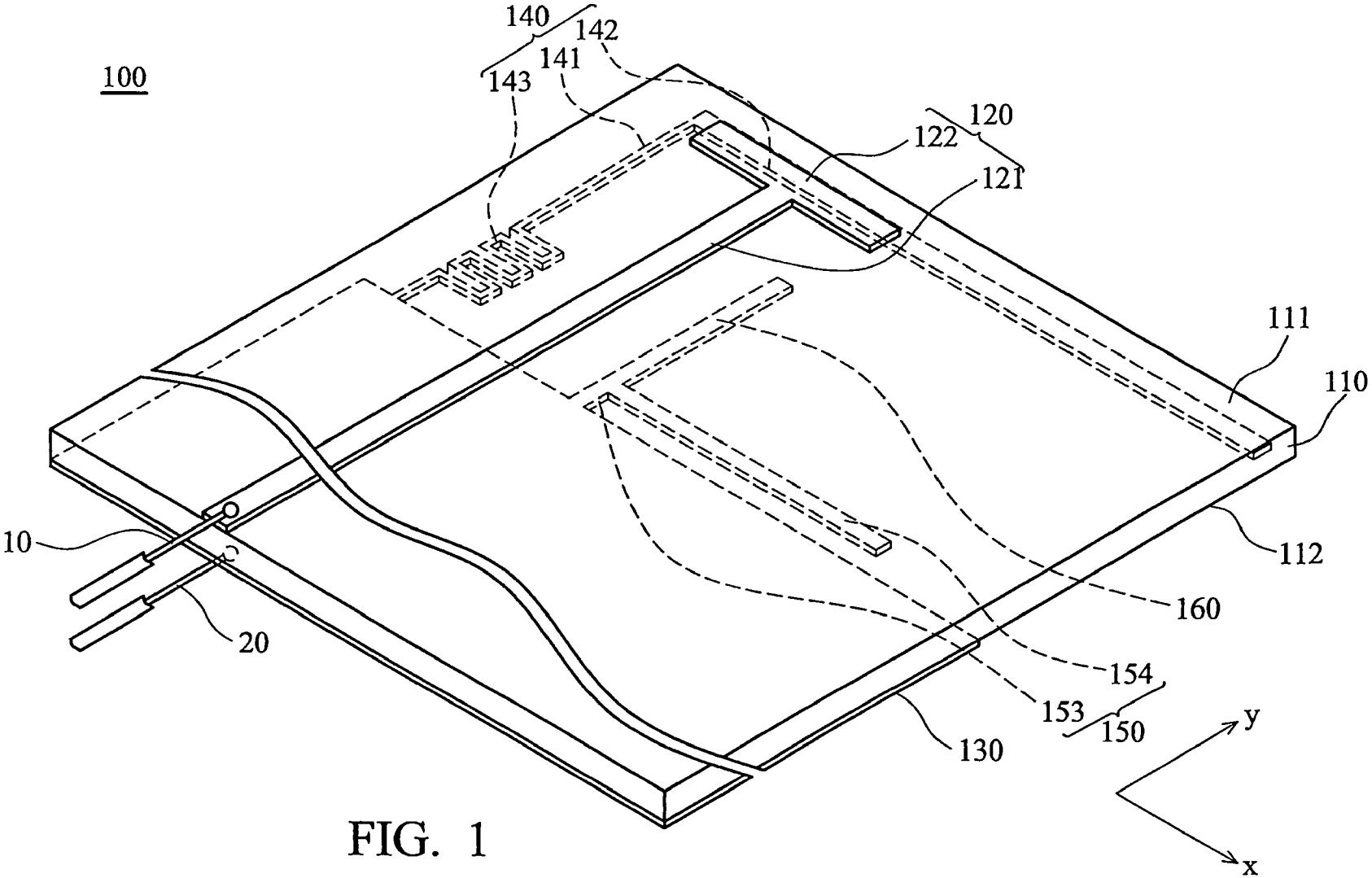
FIG. 1 shows an antenna of a first embodiment of the invention.

FIG. 1 shows an antenna 100 of a first embodiment of the invention, comprising a substrate 10, a transmission element 120, a ground element 130, a first parasitic element 140, a second parasitic element 150 and a third parasitic element 160. The substrate 110 comprises a first surface (first plane) 111 and a second surface (second plane) 112. The transmission element 120 is located on the first surface 111. The ground element 130, the first parasitic element 140, the second parasitic element 150 and the third parasitic element 160 are located on the second surface 112.

The transmission element 120 is T shaped, comprising a first transmission portion 121 and a second transmission portion 122. The first transmission portion 121 extends in a second direction y perpendicular to the second transmission portion 122. A signal line 10 is electrically connected to the first transmission portion 121. A ground layer 20 is electrically connected to the ground element 130.

Figure 3:
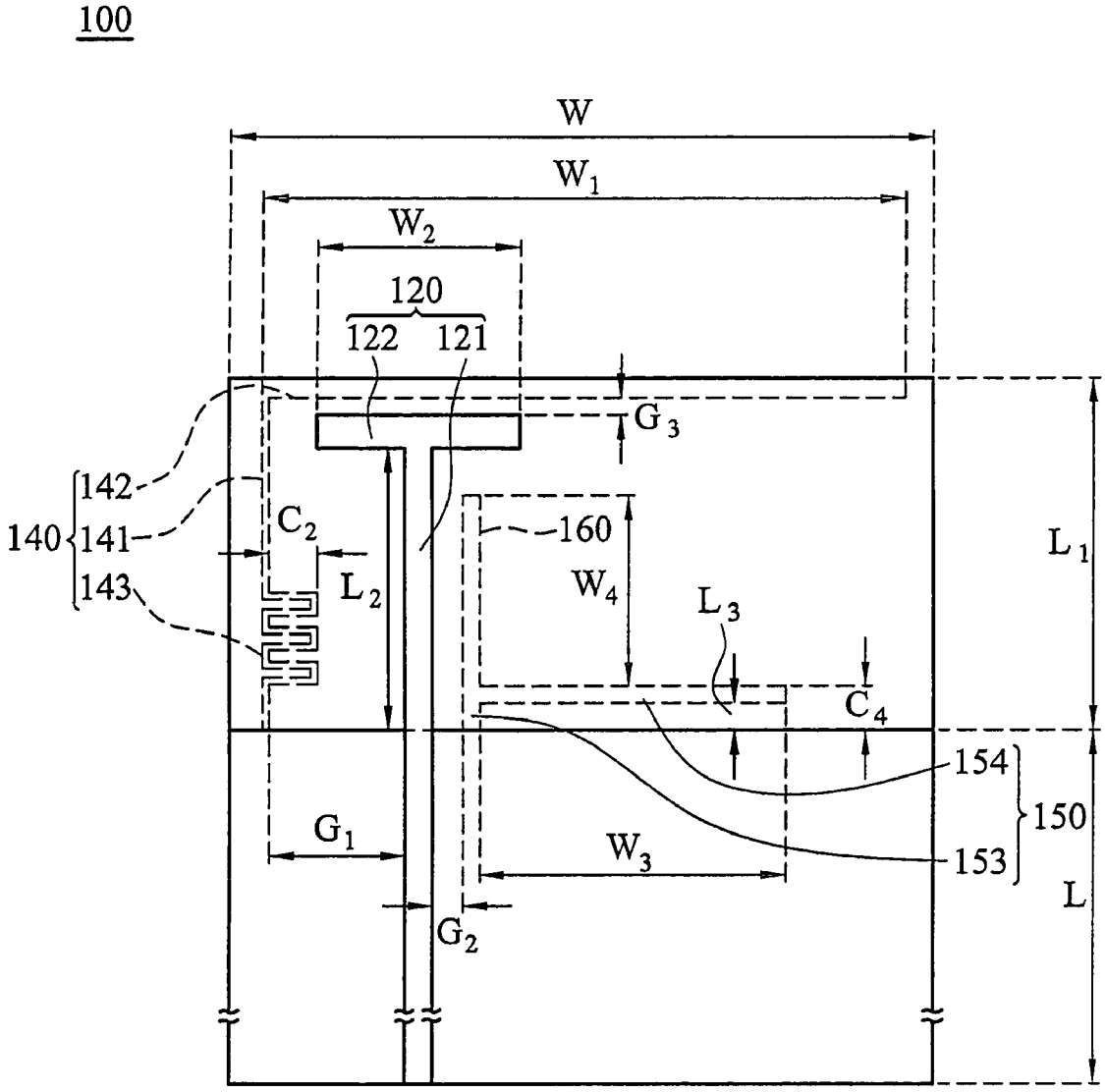
FIG. 3 is a top view of the antenna of the first embodiment of the invention.

The first parasitic element 140 comprises a first section 141 and a second section 142. The first section 141 is perpendicular to the second section 142. The first section 141 is connected to the ground element 130. The second section 142 extends in a first direction x. The first section 141 comprises a meandrous structure 143. With reference to FIG. 3, the second transmission portion 122 is located between the second section 142 and the first transmission portion 121. A first gap $G_3$ is formed between the second section 142 and the second transmission portion 122.

The second parasitic element 150 is connected to the ground element 130 comprising a third section 153 and a fourth section 154. The third section 153 is perpendicular to the fourth section 154. The third section 153 is connected to the ground element 130. The fourth section 154 extends in the first direction x nearing the ground element 130. A third gap $L_3$ is formed between the fourth section 154 and the ground element 130.

The third parasitic element 160 is connected to the second parasitic element 150 extending in the second direction y and perpendicular to the fourth section 154. The third parasitic element 160 nears the first transmission portion 121, and a fourth gap $G_2$ is formed between the first transmission portion 121 and the third parasitic element 160.

When the antenna 100 transmits wireless signal, the transmission element 120 couples the ground element 130, the first parasitic element 140, the second parasitic element 150 and the third parasitic element 160 to transmit GSM signal (890-960 MHz), DCS signal (1710-1880 MHz), PCS signal (1850-1990 MHz), UMTS signal (1920-2170 MHz), WLAN IEEE 802.11 b/g signal (2400-2500 MHz) and WiMAX signal (3400-3600 MHz). The GSM signal (890-960 MHz) signal is transmitted via the first parasitic element 140. The DCS signal (1710-1880 MHz), the PCS signal (1850-1990 MHz) and the UMTS signal (1920-2170 MHz) are transmitted via the transmission element 120. The WLAN IEEE 802.11 b/g signal (2400-2500 MHz) is transmitted via the second parasitic element 150. The WiMAX signal (3400-3600 MHz) is transmitted via the third parasitic element 160.

Figure 2:
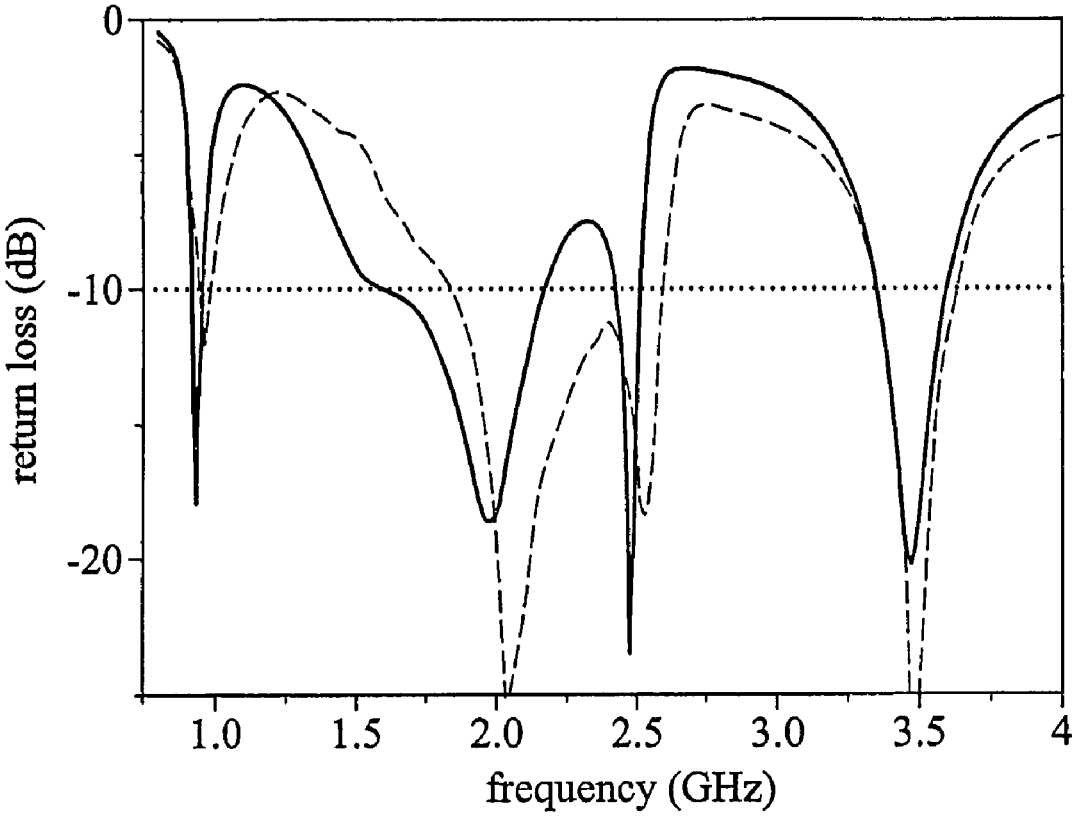
FIG. 2 shows signal reflection performance of the antenna of the first embodiment of the invention.

FIG. 2 shows signal reflection performance of the antenna 100 of the invention, wherein a dotted line shows experiment result, and continuous line shows simulation result. As shown in FIG. 2, the invention transmits GSM signal (890-960 MHz), DCS signal (1710-1880 MHz), PCS signal (1850-1990 MHz), UMTS signal (1920-2170 MHz), WLAN IEEE 802.11 b/g signal (2400-2500 MHz) and WiMAX signal (3400-3600 MHz) with a smaller sized antenna.

FIG. 3 is a top view of the antenna 100 of the invention. Line width of the first transmission portion 121 is 1.2 mm, line width of the second transmission portion 122 is 2 mm, line width of the first section 141 is 0.5 mm, line width of the second section 142 is 1 mm, line width of the second parasitic element 150 is 1 mm, and line width of the third parasitic element 160 is 1 mm. Length L of the ground element is 60 mm, and width W thereof is 40 mm. The second gap $G_1$ between the first section 141 and the first transmission portion 121 is 7.5 mm. The fourth gap $G_2$ between the third parasitic element 160 and the first transmission portion 121 is 1.8 mm. The third gap $L_3$ between the fourth section 154 and the ground element 130 is 1.5 mm. The first gap $G_3$ between the second section 142 and the second transmission portion 122 is 1 mm. Gap $C_1$ between the meandrous structure 143 and the ground element 130 is 3.5 mm. Height $C_2$ of the meandrous structure 143 is 3 mm. Length $L_1$ of the first section 141 is 20 mm. Length $W_1$ of the second section 142 is 38 mm. Distance $L_2$ between the second transmission portion 122 and the ground element 130 is 16 mm. Length $W_2$ of the second transmission portion 122 is 11.6 mm. Length $W_3$ of the fourth section 153 is 18 mm. Length $W_4$ of the third parasitic element 160 is 11.5 mm.

In the embodiment of the invention, the sum $(L_1+W_1)$ of the length $L_1$ of the first section 141 and the length $W_1$ of the second section 142 equals to about a quarter wavelength of a wireless signal with frequency of 930 MHz. A valid length $(L_2+0.5*W_2)$ of the transmission element 120 equals to about a quarter wavelength of a wireless signal with frequency of 1.9 GHz. Bandwidth of the antenna of can be modified by tuning the first gap, the second gap, the third gap and the fourth gap. The dimensions mentioned above can be modified in a range of ±50% according to different boundary conditions. For example, the first gap can be modified between 0.1 mm and 5 mm, the second gap can be modified between 3 mm and 10 mm, the third gap can be modified between 0.5 mm and 10 mm, and the fourth gap can be modified between 0.5 mm and 10 mm.

Figure 4A:
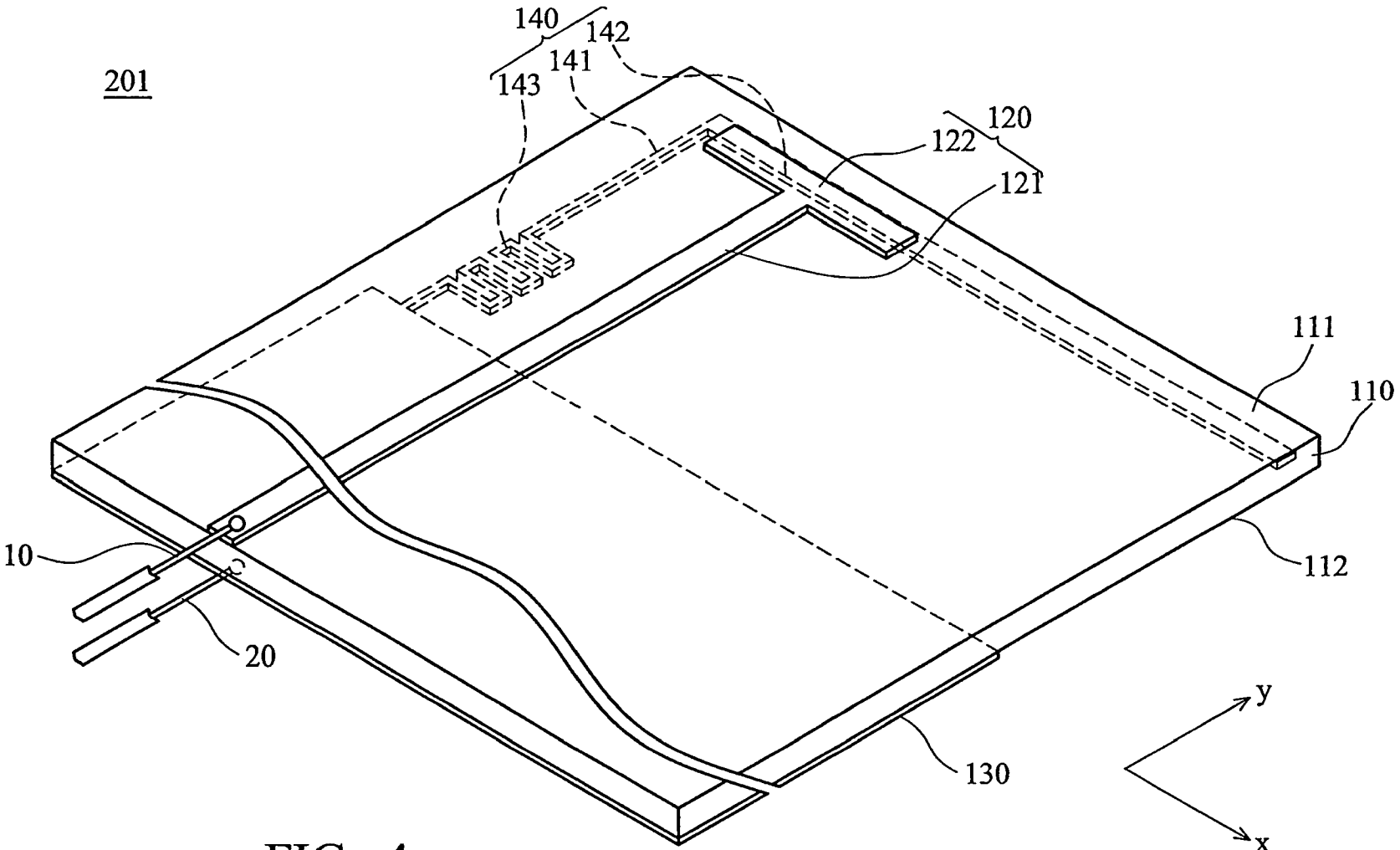
FIG. 4*a* shows an antenna of a second embodiment of the invention.

FIG. 4*a* shows an antenna 201 of a second embodiment of the invention, wherein the second and the third parasitic elements are omitted, and wireless signal is transmitted via the transmission element 120 and the first parasitic element 140.

Figure 4B:
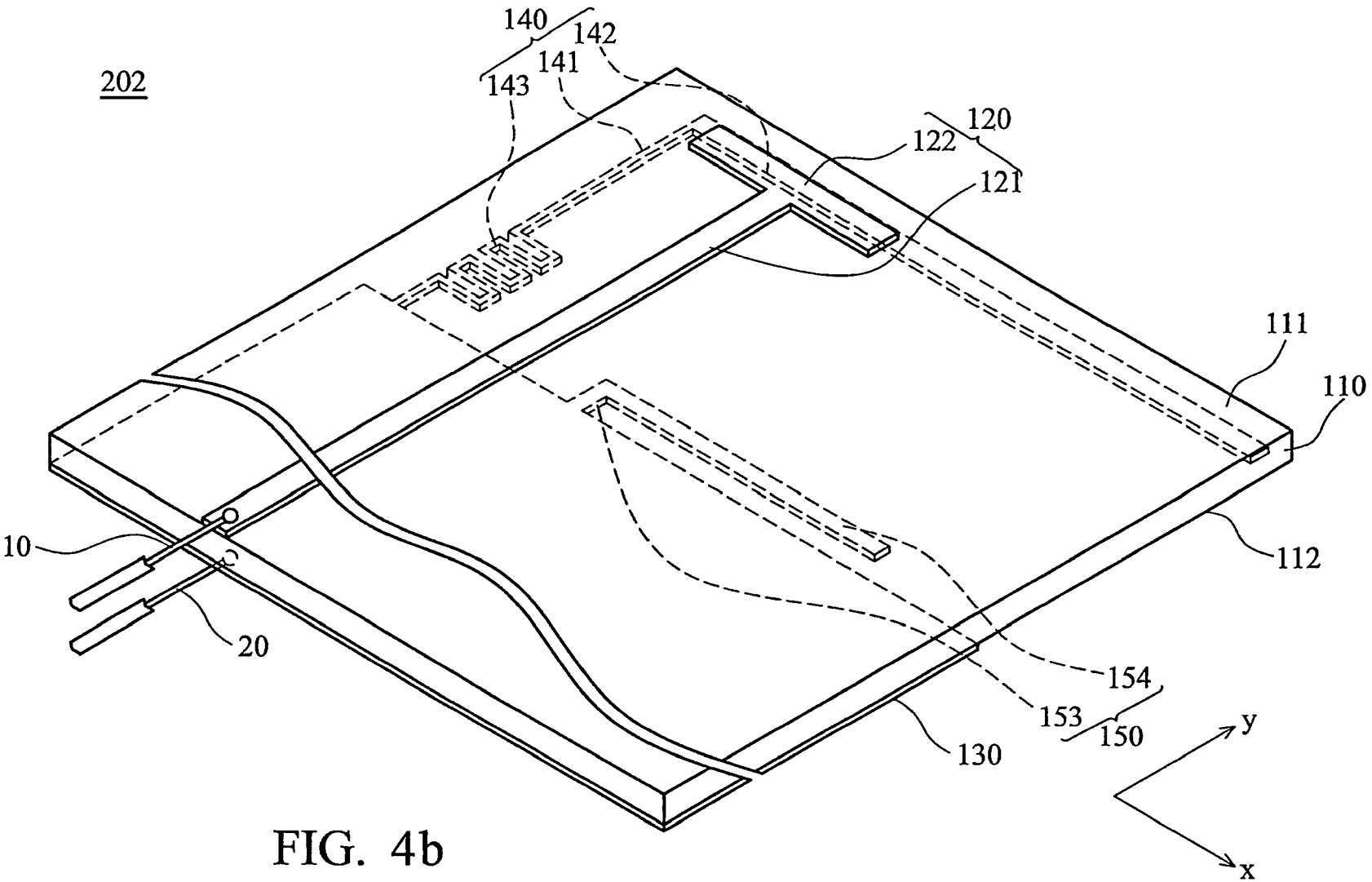
FIG. 4*b* shows an antenna of a third embodiment of the invention.

FIG. 4*b* shows an antenna 202 of a third embodiment of the invention, wherein the third parasitic element is omitted, and wireless signal is transmitted via the transmission element 120, the first parasitic element 140 and the second parasitic element 150.

Figure 5A:
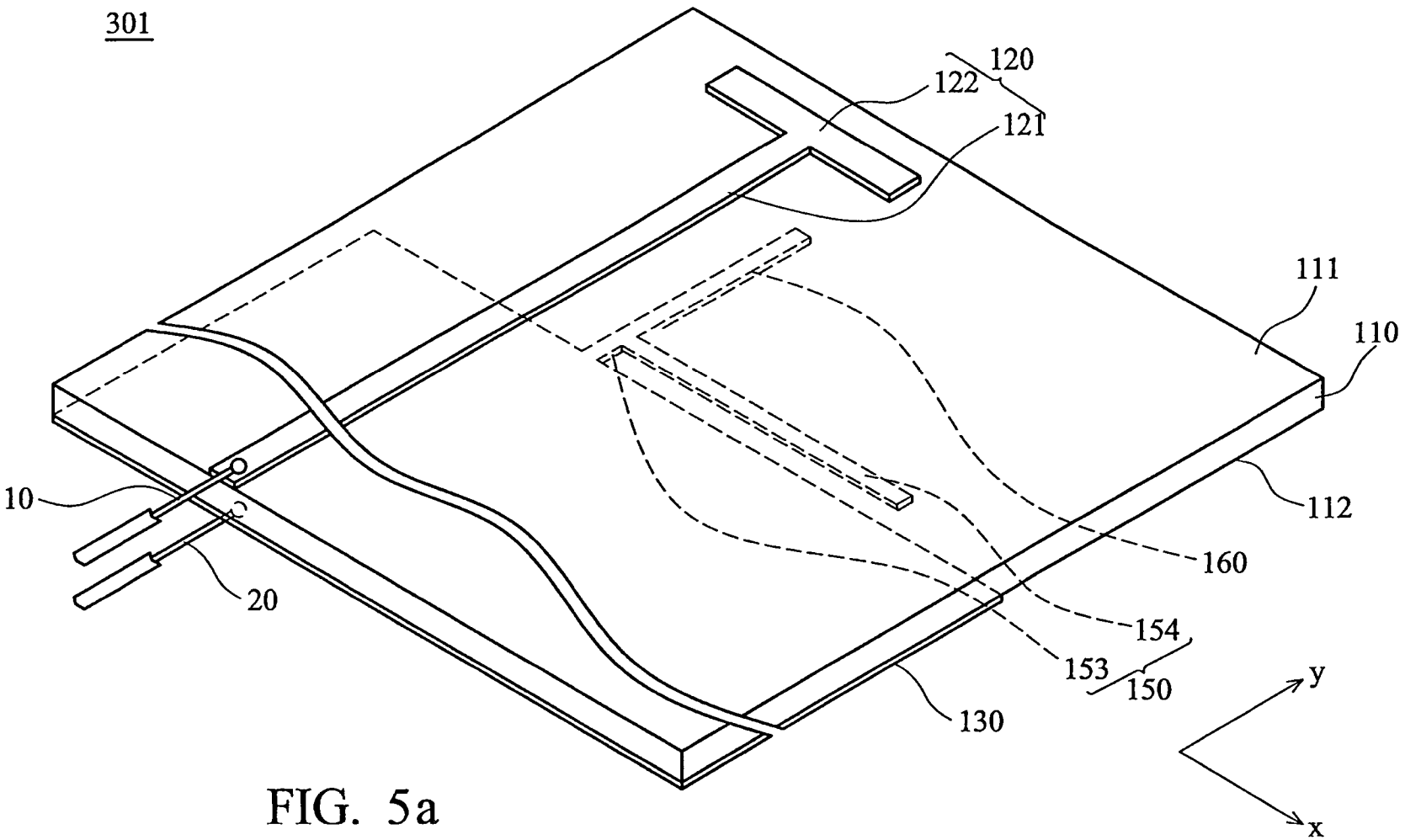
FIG. 5*a* shows an antenna of a fourth embodiment of the invention.

FIG. 5*a* shows an antenna 301 of a fourth embodiment of the invention, wherein the first parasitic element is omitted, and wireless signal is transmitted via the transmission element 120, the second parasitic element 150 and the third parasitic element 160.

Figure 5B:
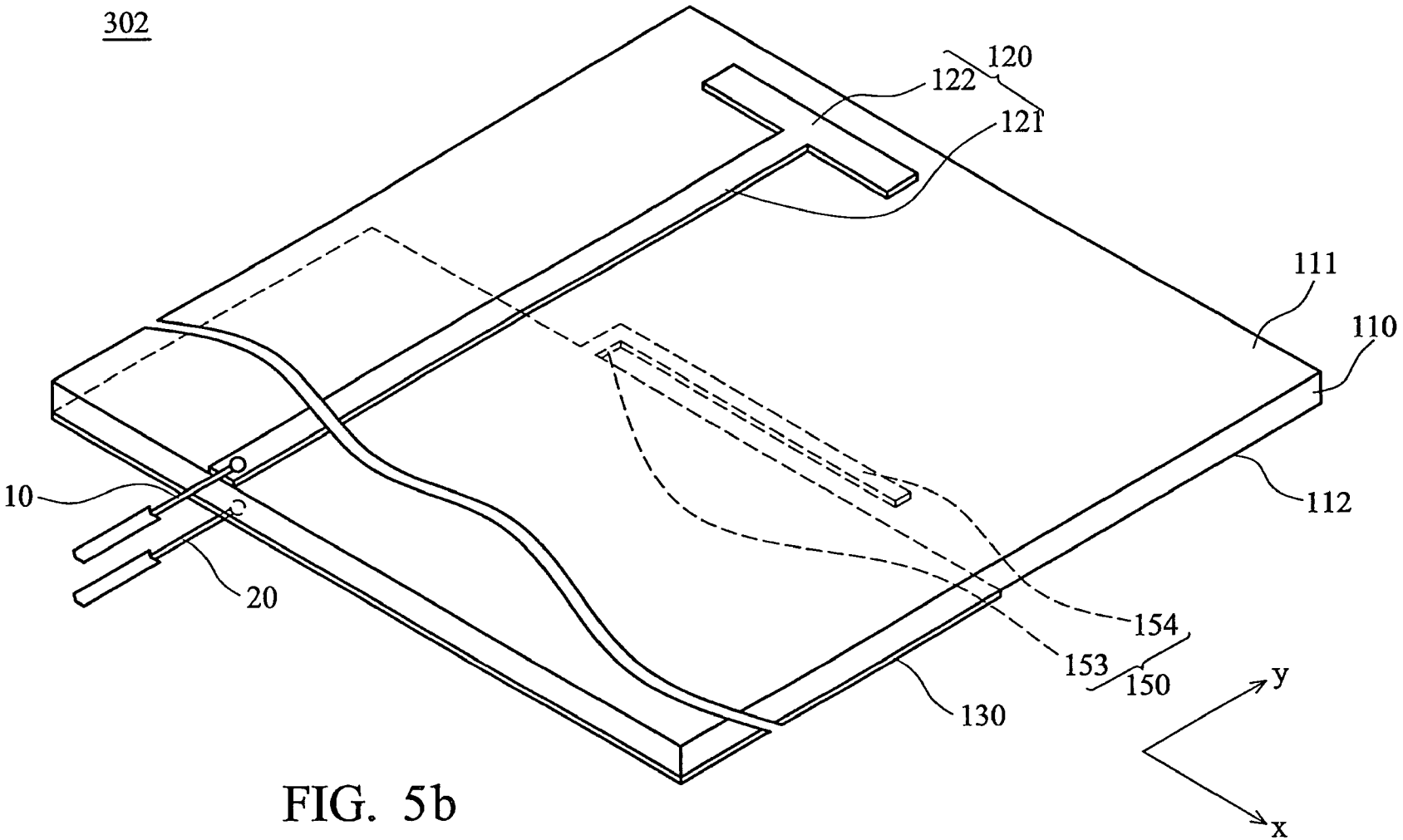
FIG. 5*b* shows an antenna of a fifth embodiment of the invention.

FIG. 5*b* shows an antenna 302 of a fifth embodiment of the invention, wherein the first parasitic element and the third parasitic element are omitted, and wireless signal is transmitted via the transmission element 120 and the second parasitic element 150.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a transmission element, located on a first plane, wherein the transmission element is T shaped, and comprises a first transmission portion and a second transmission portion and the second transmission portion is perpendicular to the first transmission portion and connected to an end thereof;

a signal line, electrically connected to the first transmission portion;

a ground element, located on a second plane parallel to the first plane;

a ground line, electrically connected to the ground element;

a first parasitic element, connected to the ground element, located on the second plane, wherein the first parasitic element comprises a first section and a second section, the first section perpendicular to the second section, the first section connected to the ground element, the second section extending in a first direction, the second transmission portion located between the second section and the first transmission portion, and a first gap is formed between the second section and the second transmission portion.

2. The antenna as claimed in claim 1, wherein the first transmission portion extends in a second direction, the second direction perpendicular to the first direction, and the second transmission portion is parallel to the second section.

3. The antenna as claimed in claim 1, wherein the first section comprises a meandrous structure.

4. The antenna as claimed in claim 1, wherein the first gap is between 0.1 mm to 5 mm.

5. The antenna as claimed in claim 1, wherein a second gap is formed between the first section and the first transmission portion, and the second gap is between 3 mm to 10 mm.

6. The antenna as claimed in claim 1, further comprising a second parasitic element, connected to the ground element, located on the second plane, wherein the second parasitic element comprises a third section and a fourth section, the third section perpendicular to the fourth section, the third section connected to the ground element, the fourth section extending in the first direction nearing the ground element, and a third gap is formed between the fourth section and the ground element.

7. The antenna as claimed in claim 6, wherein the third gap is between 0.5 mm to 10 mm.

8. The antenna as claimed in claim 1, further comprising a third parasitic element connected to the second parasitic element, wherein the third parasitic element is perpendicular to the fourth section.

9. The antenna as claimed in claim 8, wherein the third parasitic element nears the first transmission portion, and a fourth gap is formed between the first transmission and the third parasitic element.

10. The antenna as claimed in claim 9, wherein the fourth gap is between 0.5 mm to 10 mm.

11. The antenna as claimed in claim 1, further comprising a substrate, comprising a first surface and a second surface, the first plane located on the first surface and the second plane located on the second surface.

12. An antenna, comprising:

a transmission element, located on a first plane, wherein the transmission element is T shaped, and comprises a first transmission portion and a second transmission portion and the second transmission portion is perpendicular to the first transmission portion and connected to an end thereof;

a signal line, electrically connected to the first transmission portion;

a ground element, located on a second plane parallel to the first plane;

a ground line, electrically connected to the ground element;

a second parasitic element, connected to the ground element, located on the second plane, wherein the second parasitic element comprises a third section and a fourth section, the third section perpendicular to the fourth section, the third section connected to the ground element, the fourth section extending in the first direction nearing the ground element, and a third gap is formed between the fourth section and the ground element.

13. The antenna as claimed in claim 12, wherein the third gap is between 0.5 mm to 10 mm.

14. The antenna as claimed in claim 12, further comprising a third parasitic element connected to the second parasitic element, wherein the third parasitic element extends in a second direction perpendicular to the first direction.

15. The antenna as claimed in claim 14, wherein the third parasitic element nears the first transmission portion, and a fourth gap is formed between the first transmission and the third parasitic element.

16. The antenna as claimed in claim 15, wherein the fourth gap is between 0.5 mm to 10 mm.

17. The antenna as claimed in claim 12, further comprising a substrate, comprising a first surface and a second surface, the first plane located on the first surface and the second plane located on the second surface.

* * * * *